US008397450B1

(12) United States Patent
Neal

(10) Patent No.: US 8,397,450 B1
(45) Date of Patent: Mar. 19, 2013

(54) EXPLOSION RESISTANT WINDOW SYSTEM

(75) Inventor: Murray L. Neal, Fresno, CA (US)

(73) Assignee: American Development Group International, LLC, Washington, DC (US)

( * ) Notice: Subject to any disclaimer, the term of this patent is extended or adjusted under 35 U.S.C. 154(b) by 1540 days.

(21) Appl. No.: 10/241,906

(22) Filed: Sep. 12, 2002

Related U.S. Application Data

(63) Continuation-in-part of application No. 10/196,774, filed on Jul. 15, 2002, now abandoned.

(51) Int. Cl.
*E06B 1/00* (2006.01)
*E06B 1/04* (2006.01)

(52) U.S. Cl. ..... 52/210; 52/213; 52/212; 52/204.53; 52/204.1

(58) Field of Classification Search ..... 52/656.9, 52/656.4, 656.5, 204.1, 204.5, 205, 207–208, 52/210–214, 656.1, 204.53, 204.55, 204.595, 52/204.593, 204.67–204.7, 204.72, 204.705, 52/204.6, 206.66
See application file for complete search history.

(56) References Cited

U.S. PATENT DOCUMENTS

| | | | | | |
|---|---|---|---|---|---|
| 2,703,159 | A | * | 3/1955 | Van Fleet | 52/656.5 |
| 2,747,705 | A | * | 5/1956 | Bagnard | 52/476 |
| 3,283,821 | A | * | 11/1966 | Brown | 166/134 |
| 3,304,657 | A | * | 2/1967 | Singleton | 49/399 |
| 4,328,644 | A | * | 5/1982 | Scott et al. | 49/501 |
| 4,453,855 | A | * | 6/1984 | Richter et al. | 403/295 |
| 4,481,696 | A | * | 11/1984 | Kanzaka | 24/113 R |
| 4,520,602 | A | * | 6/1985 | Miller | 52/171.3 |
| 4,676,026 | A | * | 6/1987 | Schreiner | 49/501 |
| 4,689,933 | A | * | 9/1987 | Biro | 52/656.5 |
| 4,897,975 | A | * | 2/1990 | Artwick et al. | 52/208 |
| 5,373,671 | A | * | 12/1994 | Roth et al. | 52/204.1 |
| 5,618,127 | A | * | 4/1997 | Tonsmann et al. | 403/230 |
| 5,687,518 | A | * | 11/1997 | Endo et al. | 52/204.1 |
| 6,067,760 | A | * | 5/2000 | Nowell | 52/204.57 |
| 6,216,401 | B1 | * | 4/2001 | Emek | 52/204.5 |
| 6,327,826 | B1 | * | 12/2001 | Mann | 52/204.1 |
| 6,334,283 | B1 | * | 1/2002 | Edger | 52/204.1 |
| 6,385,924 | B1 | * | 5/2002 | Emek | 52/204.5 |
| 6,509,071 | B1 | * | 1/2003 | Emek | 428/34 |
| 6,572,355 | B1 | * | 6/2003 | Bauman et al. | 425/112 |
| 6,718,705 | B2 | * | 4/2004 | Emek | 52/204.69 |
| 7,174,692 | B1 | * | 2/2007 | Vickers et al. | 52/786.13 |
| 2002/0166298 | A1 | * | 11/2002 | Emek | 52/208 |
| 2003/0208970 | A1 | * | 11/2003 | Saelzer | 52/167.1 |

FOREIGN PATENT DOCUMENTS

| | | | | |
|---|---|---|---|---|
| GB | 2296020 | A | * | 6/1996 |

* cited by examiner

*Primary Examiner* — Jeanette E. Chapman
(74) *Attorney, Agent, or Firm* — Blakely, Sokoloff, Taylor & Zafman LLP

(57) ABSTRACT

An improved window system for increased protection from explosive blast attacks. The window system includes an outer anchor structure and an inner frame structure. The inner frame structure has a deep channel for retaining a glazing. The window system includes a hinge mechanism and lock mechanism for allowing the inner frame to open in relation to the outer anchor structure.

26 Claims, 15 Drawing Sheets

210
THREAT
SIDE
312
314
316
318
202
204
SAFE
SIDE

EXPLOSION RESISTANT WINDOW SYSTEM

CROSS-REFERENCE TO RELATED APPLICATION

The application is a Continuation-In-Part of application Ser. No. 10/196,774, filed Jul. 15, 2002 now abandoned by applicant, Murray L. Neal entitled "Explosion Resistant Window System."

BACKGROUND

1. Field of the Invention

The present invention relates generally to frames that support glazings, and more specifically, relates to a method and apparatus for an improved system for supporting a glazing.

2. Description of the Related Art

In an increasingly violent society, businesses and homes are subject to an increased number of threats against both life and property. These threats to life and property can include ballistic threats, threats of explosive blasts, forced entry threats, and others.

Businesses and homes in areas of high crime are increasingly forced to employ security measures to protect against these threats. These security measures include the installation of glazings with increased strength. For example, bullet resistant glazings or glazings that can resist certain explosive blast threats are finding their way into both residential and industrial buildings.

Additionally, buildings in areas that are subject to natural disaster, such as hurricanes, tornadoes and severe storms, require weatherproofing and additional protection from the elements.

Unfortunately, conventional security improvement schemes require that the existing window and frame be removed and replaced with a new glazing unit and a new frame. Because the old windows and frames need to be removed first before the new windows and frames can be installed, the costs of such a job are greatly increased. Moreover, the area downtime, that is, the time required for workmen to come in, tear down the existing structure, and install the new structure, is also substantial. Furthermore, there is a risk of contamination to the work-area resulting from the demolition and reconstruction of the frame and surrounding building structure.

Another disadvantage of conventional schemes is that the noise, commotion and disruption inherent in tearing out the old frame and existing building materials, in addition to the significant down-time, precludes a discreet security enhancement. Because of the conspicuous nature of conventional schemes, they may unnecessarily cause fear in the workplace or unwittingly reveal to third parties the additional security measures.

Also, the conventional technique for increasing the security of a building is time-consuming and costly, requiring substantial lead time for pre-fabrication of the new frame prior to installation.

Furthermore, conventional retrofit methods for increasing the security of a building cannot be aesthetically finished and leave unsightly anchoring, such as screws or other evidence of sizing the frame (e.g., cut marks, edges, scratches). Once the new window glazing is in place, conventional frames do not allow for upgrades to glazings with a greater thickness. In order to upgrade with conventional frames, the entire frame must be removed and a suitable frame having dimensions to accommodate the glazing having a greater thickness must be installed.

Another disadvantage is that conventional frames and methods to install them are costly, time-consuming, and require two or more workers to aid in positioning the glass or glazing in the frames.

Conventional frames are not designed to withstand both the positive phase and negative phase of an explosive detonation (explosion). The positive phase of an explosion is characterized by highly compressed air traveling radially outward from the source of the explosion at supersonic velocities. The negative phase of an explosion is characterized by the shockwave falling below surrounding atmospheric pressure creating suction. Behind the shockwave, a vacuum is created and air rushes in to fill the vacuum creating high intensity wind or drag pressure on the surfaces of buildings and other structures.

A well known standard for grading the blast resistant quality of a window system is the Protection Level ratings established by the Government Services Administration (GSA) for federal facilities. Based upon reproducible tests performed by the U.S. Army Corps of Engineers, Table I identifies the ratings and security criteria of the GSA. These levels of protection are for positive over blast pressure only, and do not account for fragmentation and/or shrapnel impacts.

TABLE I

| Performance/ Protection Level | Description of Window Glazing Condition |
|---|---|
| 1 - Safe | Glazing does not break. No visible damage to glazing or frame. |
| 2 - Very High | Glazing cracks, but is retained by the frame. Dusting or very small fragments near sill or on floor acceptable. |
| 3a - High | Glazing cracks. Fragments enter space and land on floor no further than 3.3 feet from the window. |
| 3b - High | Glazing cracks. Fragments enter space and land on floor no further than 10 feet from the window. |
| 4 - Medium | Glazing cracks. Fragments enter space and land on floor and impact a vertical witness panel at a distance of no more than 10 feet from the window at a height no greater than 2 feet above the floor. |
| 5 - Low | Glazing cracks and window system fails catastrophically. Fragments enter space, impacting a vertical witness panel at a distance of no more than 10 feet from the window at a height greater than 2 feet above the floor. |

Accordingly, there remains a need in the industry for an improved window system and a method of installing the improved window system that overcomes the disadvantages set forth above.

BRIEF DESCRIPTION OF THE DRAWINGS

Various embodiments are illustrated by way of example and not by way of limitation in the figures of the accompanying drawings in which like references indicate similar elements. It should be noted that references to "an," "one," or "various" embodiments in this disclosure are not necessarily to the same embodiment, and such references mean at least one.

DETAILED DESCRIPTION

Figure 1A:
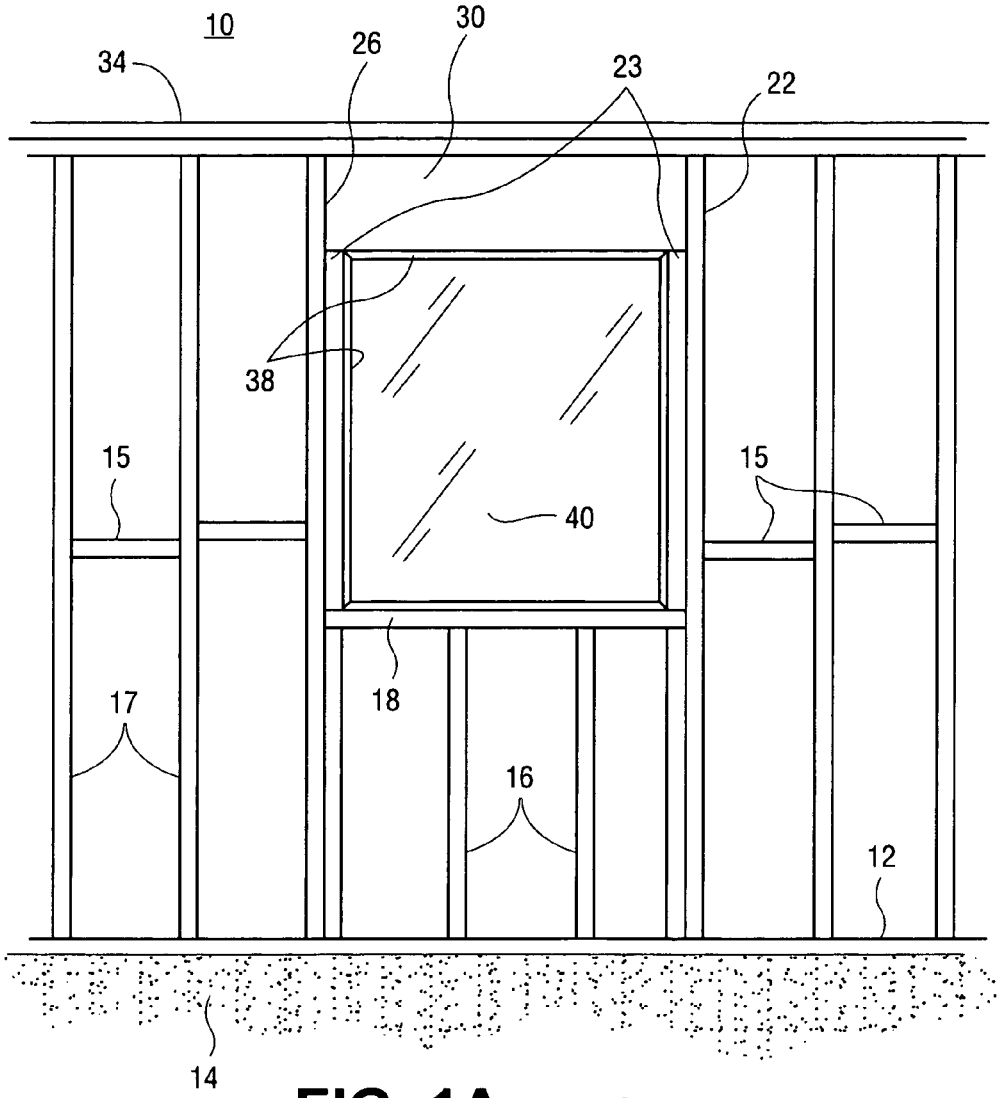
FIG. 1A (PRIOR ART)
FIG. 1A illustrates an elevational view of a building structure and window system.

FIG. 1A illustrates an elevational view of an exemplary structure 10 in which a window system can be implemented. The structure 10 can be found in commercial and residential buildings having either wood or steel framing. The structure 10 includes a bottom plate 12 which is coupled to a foundation 14. A plurality of cripple studs 16 extend from the bottom plate 12 to a sill 18. Common studs 17 extend from the bottom plate 12 to a double top plate 34. Common studs that help to define an opening such as a doorway or window are commonly referred to as king studs 22 and 26. The sill 18 includes a first end that is coupled to a first king stud 22 and a second end that is coupled to a second king stud 26. Blocking studs 15 are disposed between common studs 17. A header 30 is coupled to the king studs 22, 26 and the double top plate 34 which is coupled to a roof line or to a next floor. Trimmer studs 23 each have one portion that extends between the bottom plate 12 and the sill 18 and a second portion that extends from the sill 18 to the header 30. An existing window frame 38 is coupled to the sill 18, the king studs 22 and 26, the trimmer studs 23 and the header 30. An existing glazing 40 is held by the existing frame 38.

In one embodiment an improved window system can be coupled to the sill 18, the king studs 22 and 26, and the header 30 as a secondary window to the existing glazing 40. In another embodiment, an improved window system replaces the glazing 40.

Figure 1B:
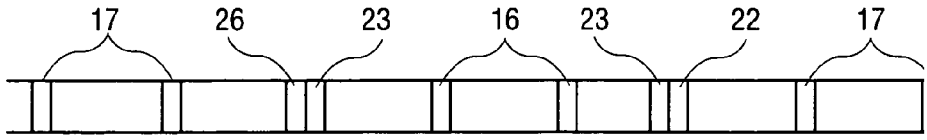
FIG. 1B (PRIOR ART)
FIG. 1B illustrates a plan view of the building structure of FIG. 1A.

FIG. 1B illustrates a plan view of a plate layout of the structure illustrated in FIG. 1A. The plate layout includes king studs 22 and 26, trimmer studs 23, common studs 17, and cripple studs 16.

Figure 2:
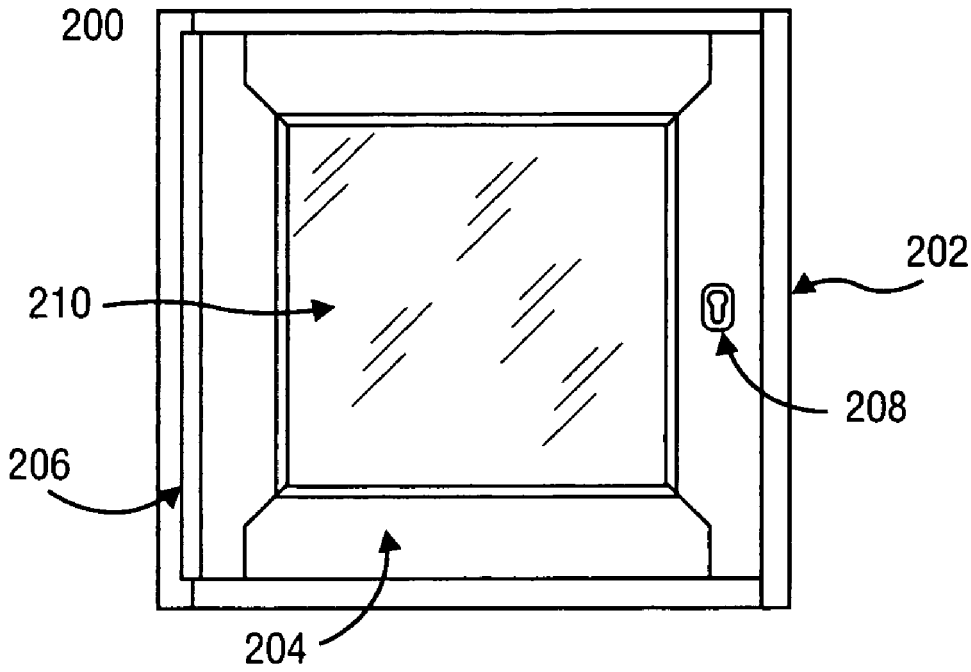
FIG. 2 illustrates an elevational view of a window system.

FIG. 2 illustrates an elevation view of one embodiment of an improved window system 200. The window system 200 includes anchor tube sections 202, frame sections 204, hinge 206, lock mechanism 208 and glazing 210. The window system 200 is designed to resist an explosion through positive deflection and minimal absorption.

Figure 3:
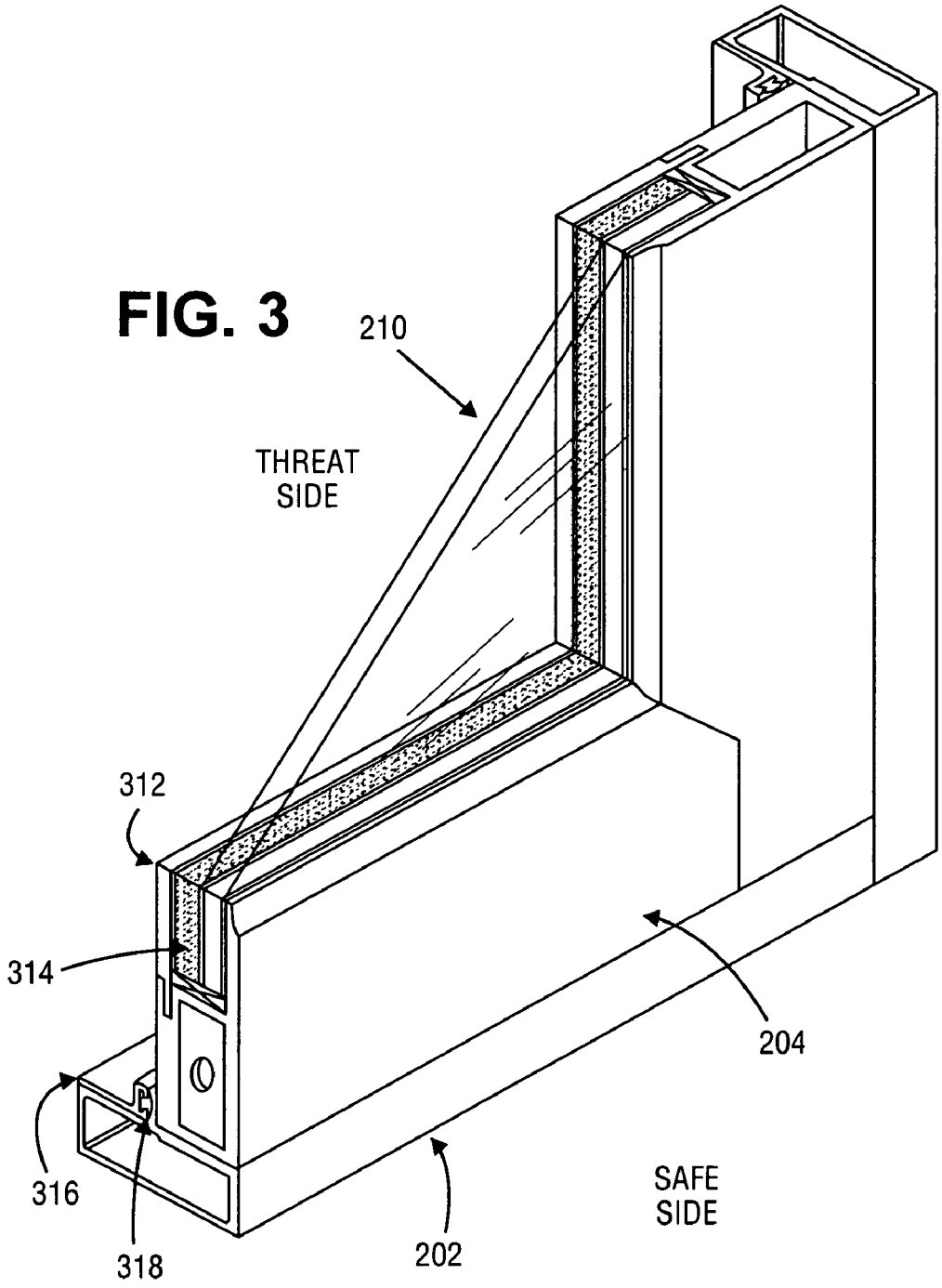
FIG. 3 illustrates a partial perspective view of the window system of FIG. 2.

FIG. 3 illustrates a cross-section of the frame 204 and anchor tube 202 of one embodiment of the window system 200. The window system 200 has a threat side and safe side.

In one embodiment, the anchor tube 202 is rectangular in shape longitudinally and hollow. The anchor tube 202 has an increased wall thickness adjacent to the frame 204. The increased thickness of the wall in this portion of the anchor tube 202 improves the strength of the anchor tube 202 as a mounting point for the frame 204 and as a strong point for the locking mechanism 208 to engage. In one embodiment, the increased thickness of wall provides for a strong point that a hinge 206 and lug pins (not shown) can anchor into. The anchor tube 202 is designed to resist tearing or stretching of the fabrication material during the positive blast pressure phase of an explosion, and to resist forced entry, prying and bending of the window system 200. In one embodiment, the anchor tube 202 is composed of aluminum 6063-T5 or similar material. Use of aluminum 6063-T5 makes the anchor tube 202 of lighter weight and consequently easier to install and less expensive than a steel anchor tube.

In one embodiment, the anchor tube 202 is designed to be physically attached to an existing window frame 38 or to the casing of a window opening or similar structure. The anchor tube 202 is attached to a building by anchors from four inches to twelve inches from center through existing frames, casing materials or like structures and further is mounted to the structural framing members of the building structure. The spacing of the anchors is dependent on the nature of an anticipated threat. Closer spacing is used for higher threats.

The anchor tube 202 is attached to a building material in such a way as to reinforce the existing frames by either anchoring through the frames or by providing a substantial stopping mechanism directly behind the safe side or inside the existing frame. In one embodiment, this is accomplished by having the anchors located from four to twelve inches from center, dependent upon the type of anticipated threat. The greater the explosive threat, the closer the anchors are placed to each other. The anchors are mounted through the thickest portion of the anchor tube 202. In one embodiment, a brace bar is used to reinforce against lateral tearing of the anchor tube 202 by inserting the brace bar into the anchor tube 202 interior adjacent the portion with thicker walls.

Figure 4:
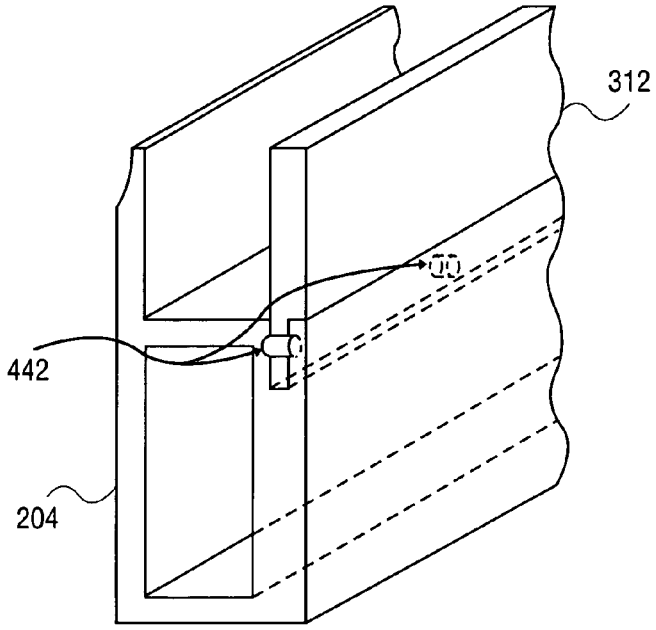
FIG. 4 illustrates a perspective view of a frame of the window system of FIG. 2.

In one embodiment, the frame 204 is fabricated as a roughly rectangular structure with one side extending to define a portion of a channel for housing a glazing 210. The frame 204, also defines a trench for attaching a glazing stop 312. FIG. 4 illustrates one embodiment of the frame 204 and glazing stop 312 showing that the frame 204 is hollow. Frame 204 is manufactured from aluminum 6063-T5 or similar material. Frame 204 and glazing stop 312 combine to define a channel to house the glazing 210. The depth of the glazing channel improves the strength of the window system 200. The depth of the glazing channel is at least 1.25 inches, thereby providing a substantially deep retention grip around the perimeter of the glazing 210. The frame 204 is reinforced on the threat side to limit lateral shear stresses that cause failure by bending or twisting the frame 204. The frame 204 is cut to angles at the ends of each section to aid in eliminating twisting and the torque of the corners during high pressure loading. The glazing 210 can be easily removed and field replaced by removal of the glazing stops 312. The glazing stops 312 are held in place within a trench in the frame 204 and secured by a spring pin 442 for security from removal during any attempted vandalism or from excessive pullout during the positive or negative phase of an explosion.

In one embodiment, illustrated in FIG. 3, an infill bar 314 rests in the channel defined by the frame 204 and glazing stop 312. The infill bar 314 fills a gap between the glazing 210 and the glazing stop 312. The infill bar 314 aides the frame 204 structure to counteract lateral shear stress. In one embodiment, infill bar 314 is manufactured from an aluminum alloy, such as aluminum 6063-T5 or similar material. The thickness of the infill bar 314 is determined by the gap left by a glazing 210, if any.

Figure 5:
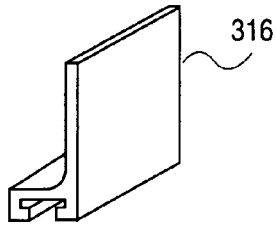
FIG. 5 illustrates a perspective view of a rail stop.
Figure 6:
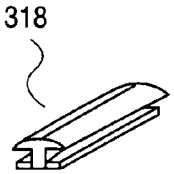
FIG. 6 illustrates a perspective view of a stop vinyl.
Figure 7:
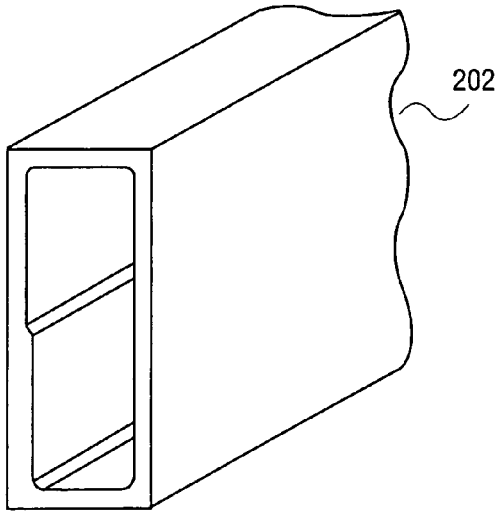
FIG. 7 illustrates a perspective view of an anchor tube.

In one embodiment, a stop rail 316 is mounted on the anchor tube 202 adjacent the frame 204 on the threat side of the window system 200. The stop rail 316 defines a T-section space that holds a stop vinyl 318. The stop rail 316 limits lateral movement of the frame 204 toward the threat side. The stop vinyl 318 seals the frame 204, preventing airflow between the frame 204 and anchor tube 202. The stop rail 316 and stop vinyl 318 limit the lateral movement of the frame 204 to prevent over-extension during normal use. In addition, the stop rail 316 and stop vinyl 318 provide support to the frame 204 during the negative phase of an explosion to prevent failure due to pull out of the hinged frame 204 toward the exterior of a building. The stop rail 316 and stop vinyl 318 also relieve stress from the multi-point locking system 208 during the negative phase of the explosion. FIG. 5 illustrates a perspective view of the stop rail 316. FIG. 6 illustrates a perspective view of the stop vinyl 318.

In one embodiment, the stop rail 316 is composed of aluminum 6063-T5 or similar material. Use of aluminum 6063-T5 makes the stop rail 316 of lighter weight and consequently easier to install and less expensive than a steel stop rail. In one embodiment, the stop vinyl 318 is composed of extruded virgin vinyl or similar materials. Virgin vinyl maintains elasticity and shape well over time and in the presence of Ultra Violet (UV) energy sources.

In one embodiment, the window system 200 is designed to accommodate a glazing 210 having a thickness from ¼ inch to 13/16 inch. Various types of glazings can be used such as all laminated glass, glass clad polycarbonates, laminated polycarbonates, monolithic polycarbonates, acrylic/glass/polycarbonate hybrids and similar glazings. The type and thickness of glazing 210 used in the window system 200 determines the explosive blast over pressure resistance, based on varied charge weight configurations, stand off distances, and explosive types. In one embodiment, the glazing 210 is designed to resist forced entry threats, ballistic threats and natural disaster threats. Additionally, specific glazings also have greater resistance to explosive blast encasement fragmentation and other shrapnel associated with explosive blasts that could cause failure of the glazing 210 before the positive phase of an explosion.

Table II shows the force resistance for various thickness of laminated glass composites.

TABLE II

| Nominal Thickness (approximate in inches) | Minimum Force Resistance Capability (PSI = lbs./in$^2$) |
|---|---|
| 5/16 | 4 PSI |
| 3/8-7/16 | 10 PSI |
| 9/16-5/8 | 15 PSI |
| 11/16-15/16 | 20 PSI |

In one embodiment, the laminated glass composite is a polyvinylbutyral (PVB) interlayered glass, where the PVB layer is a single ply. In one embodiment, the laminated glass composite includes a polyethylene terephthalate (PET) layer. Table III shows the relation of glazing thickness to layer thickness in one embodiment of the invention.

TABLE III

| Thickness (inches) | Layer Thickness From Threat Side to Safe Side (inches) |
|---|---|
| 5/16 | 1/8 annealed glass |
| | .060 PVB interlayer |
| | 1/8 annealed glass |
| 3/8-7/16 | 3/16 annealed glass |
| | .060 PVB interlayer |
| | 3/16 annealed glass |
| 9/16-5/8 | 1/4 annealed glass |
| | .060 PVB interlayer |
| | 1/4 annealed glass |
| | .060 PVB/PET spall shield |
| 11/16-15/16 | 3/8 annealed glass |
| | .060 PVB interlayer |
| | 3/8 annealed glass |
| | .060 PVB/PET spall shield |

In one embodiment, the glazing 210 is lightweight making it suitable for use in structures that require an improved window system that is sufficiently light while meeting security standards such as the various Protection Levels defined by the GSA, the UL 972 Burglary Resistance Standard and Dade County Hurricane Standard. Table IV identifies the weight and force resistance of a glazing 210 of a nominal thickness.

TABLE IV

| Nominal Thickness (inches) | Weight (pounds per square foot) | Minimum Force Resistance Capability (PSI = lbs./in$^2$) |
|---|---|---|
| 0.309 | 3.65 | 4 PSI |
| 0.439 | 5.28 | 10 PSI |
| 0.635 | 6.67 | 15 PSI |
| 0.933 | 10.46 | 20 PSI |

Figure 8B:
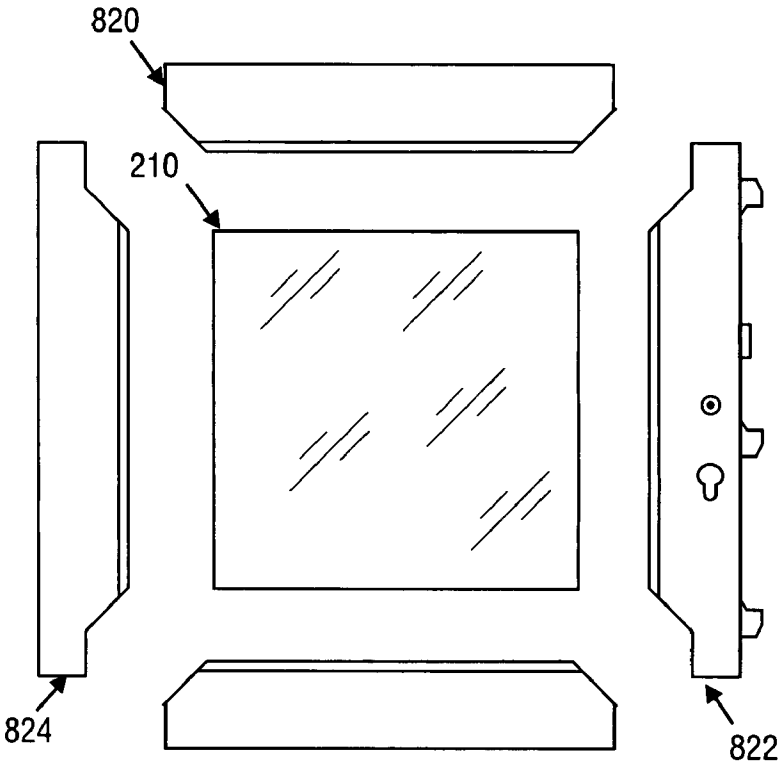
FIG. 8B illustrates an exploded view of the frame of FIG. 8A.
Figure 8A:
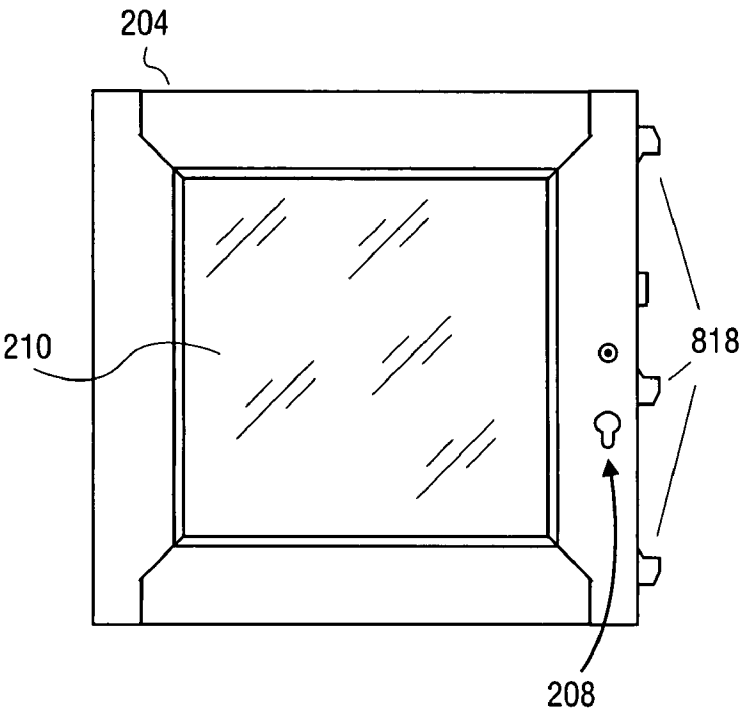
FIG. 8A illustrates an elevational view of a frame of the window system of FIG. 2.

FIG. 8A illustrates one embodiment of the frame 204. The lock mechanism 208 includes multiple lugs 818 for engaging the anchor tube 202. The lugs 818 are spaced evenly along the length of the frame 204. One lug 818 is near the center of the frame, but offset from the lock mechanism 208. The peripheral lugs 818 are spaced equidistant from the center horizontal line of the frame 204. This spacing of the lugs 818 distributes the load of a force applied to the frame 204. In one embodiment, the lock lugs 818 are solid stainless steel.

FIG. 8B illustrates an exploded view of one embodiment of the frame 204 without the anchor tubing 202. The frame 204 is composed of sections 820, 822 and 824. In one embodiment, top and bottom sections 820 are identical, defining a channel for glazing 210 and designed to house the length of an all rod (not shown) which is attached at either end to frame sections 824 and 822. Section 824 is designed to be mounted to a hinge 206. Section 822 houses a locking mechanism 208 including the multi-point mechanism that engages the anchor tubing 202. The locking mechanism 208 includes a keyed lock mechanism. In one embodiment, the frame 204 includes a lock mechanism 208 designed for a "pick proof" key that utilizes four sides of the key to activate a cylinder. Each side of the key having holes of different diameters and depths to engage a four sided internal cylinder locking mechanism. The locking mechanism 208 that is internal to section 822 is offset from the key hole mechanism to prevent direct damage to the key hole from damaging the remainder of the lock mechanism that might result in the disengagement of the lock mechanism. This provides additional security against forced entry.

Figure 9:
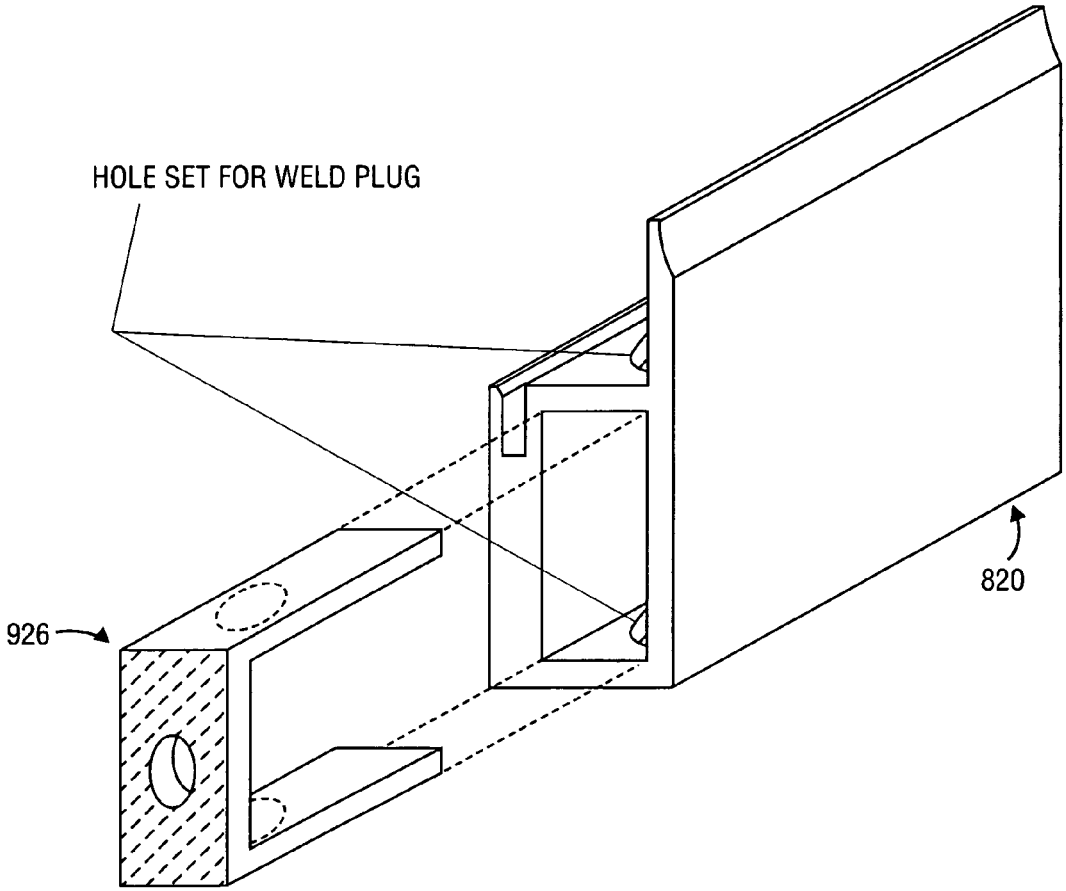
FIG. 9 illustrates an exploded view of a frame and a brace channel.

FIG. 9 illustrates an end view of a frame section 820 and a brace channel 926. In one embodiment, the frame section 820 has weld plug holes that allow for brace channel 926 to be welded to the frame section 820. Brace channels 926 are welded into place to limit the twisting of the four sections of the frame 204. In one embodiment, screw anchors or similar devices are used to attach the brace channel 926 to the frame 204. In one embodiment, the brace channel 926 is composed of aluminum 6063-T5 or similar material. Use of aluminum 6063-T5 makes the brace channel 926 of lighter weight, easier to install and consequently less expensive than a steel brace channel.

Figure 10:
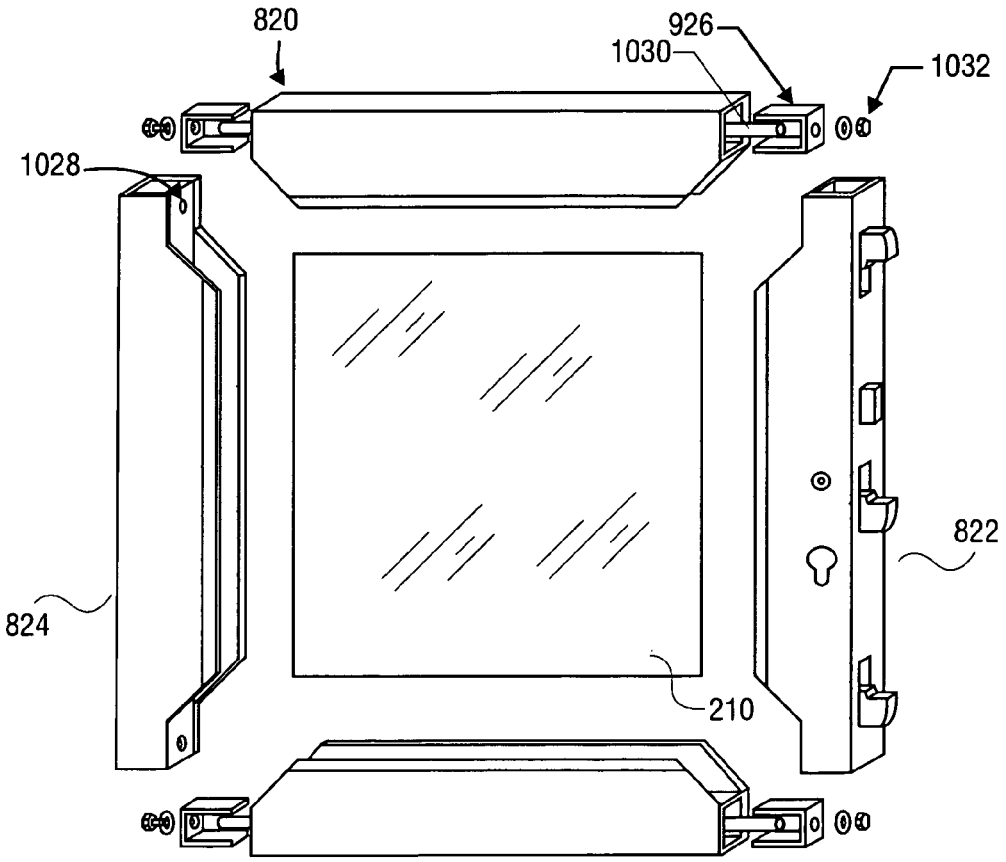
FIG. 10 illustrates an exploded view of a frame and glazing of the window system of FIG. 2.

FIG. 10 illustrates an exploded view of the frame 204 including all rod 1030 and brace channel 926. In one embodiment, an all rod 1030 runs through the length of frame section 820. Brace channel 926 is attached to the interior of frame section 820. The all rod 1030 protrudes through the hole in the brace channel 926. Frame section 820 is coupled to frame section 822 and frame section 824 by fitting the all rod 1030 into holes 1028 in frame sections 822 and 824. The frame sections are fastened together using a nut or similar device for fastening or coupling. In one embodiment nylon sleeved stainless steel locking nuts 1032 are used. In one embodiment, the all rod 1030 is manufactured from stainless steel. The placement of the all rod 1030 decreases the probability of failure at the weld joints of the brace channels 926. In one embodiment, the all rod is a ⅜ inch diameter stainless steel rod.

Figure 11:
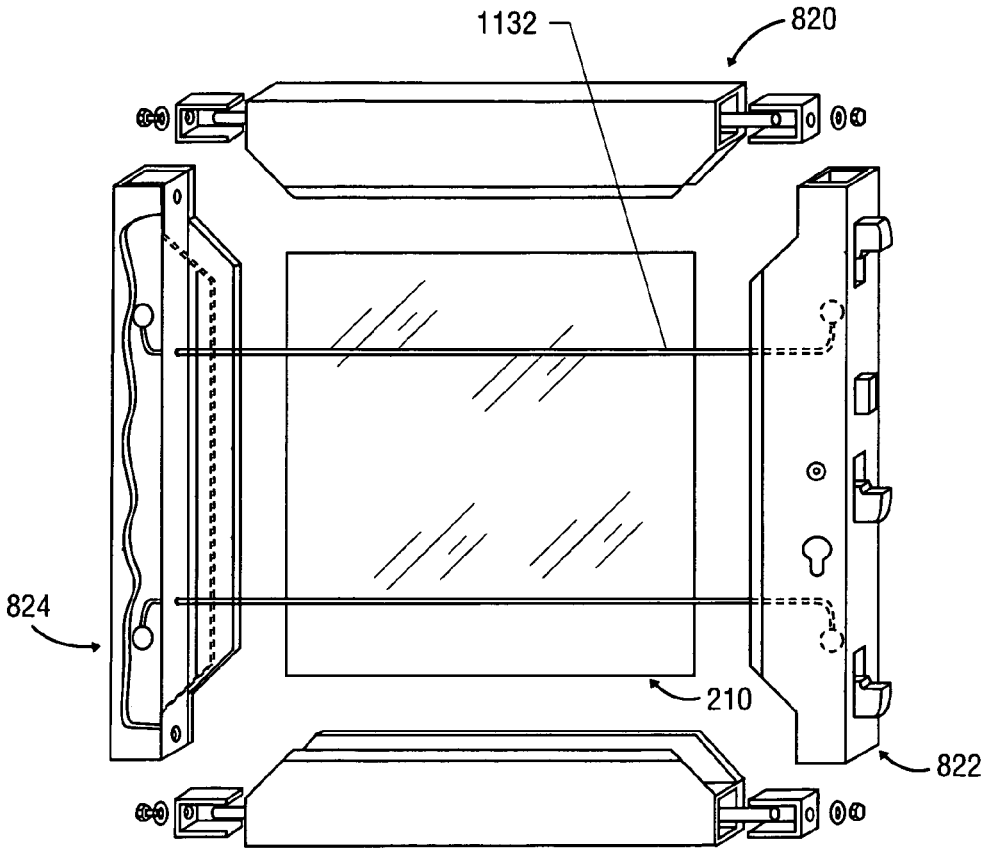
FIG. 11 illustrates an exploded view of a frame system with an arresting cable.

FIG. 11 illustrates an exploded view of one embodiment including an arresting cable 1132 attached at each end to the frame 204 and running through the glazing 210. The arresting cable 1132 contains the glazing 210 if a mounting failure occurs on any engaged edge of the glazing 210. In one embodiment, the arresting cable is 1/16 inch in diameter and lies horizontally across the safe side of glazing 210 in a PVB and PET laminate.

In one embodiment, the arresting cable 1132 is composed of stainless steel or similar material. The use of stainless steel provides high strength coupled with non-corroding or rusting quality, thereby eliminating precipitation creep common in metal reinforced safety glazings. The arresting cable 1132 is laid into a set of grooves cut into the safe side of glazing 210 and held in place by the adhesion of a PVB and PET coating. This coating provides scratch and abrasion resistance and the combined laminate is a spall lining. A spall lining precludes crushed or broken glass from separating from the glazing and entering the safe area of a building.

Figure 12:
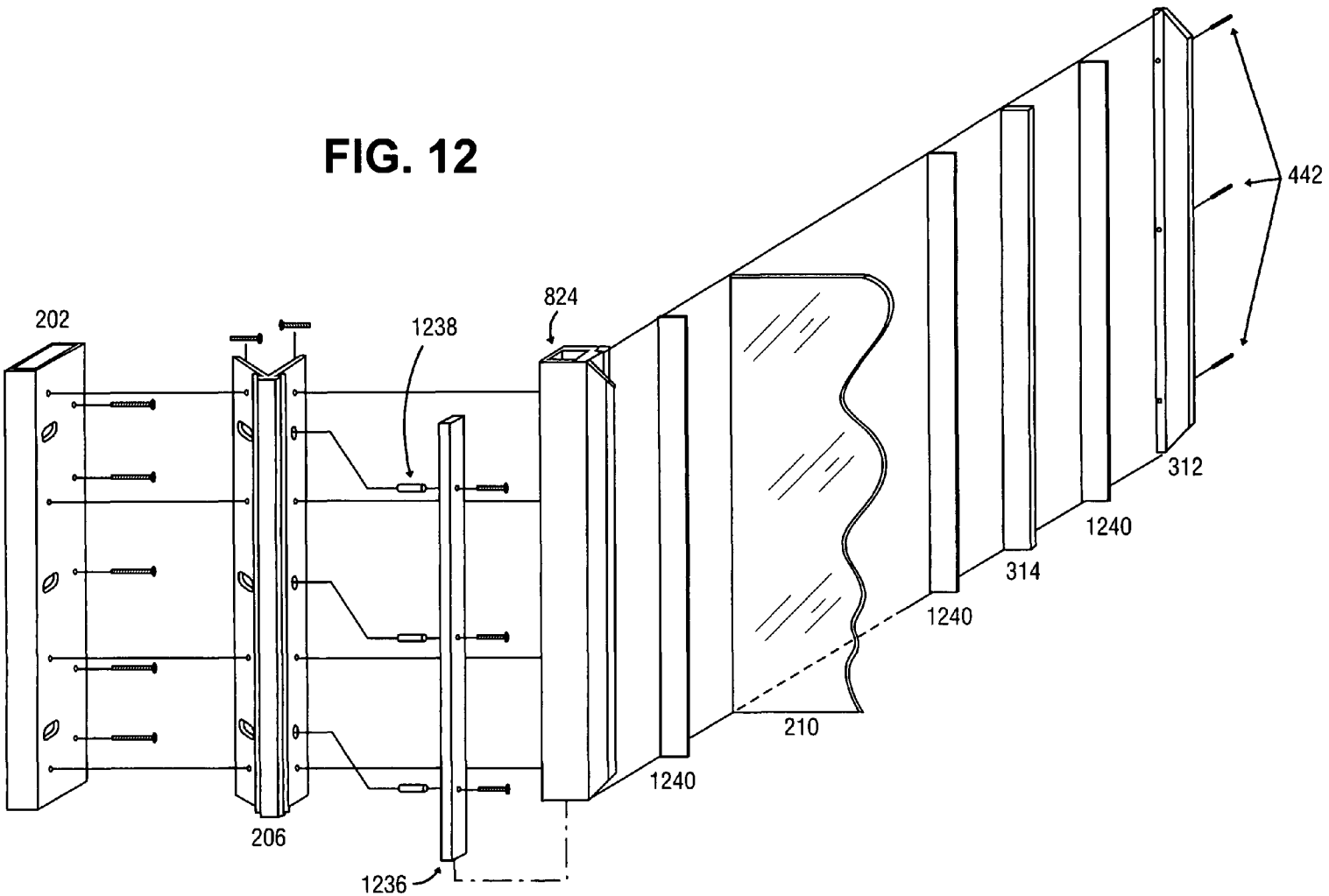
FIG. 12 illustrates an exploded view of a hinge, anchor tube and frame of the window system of FIG. 2.
Figure 13:
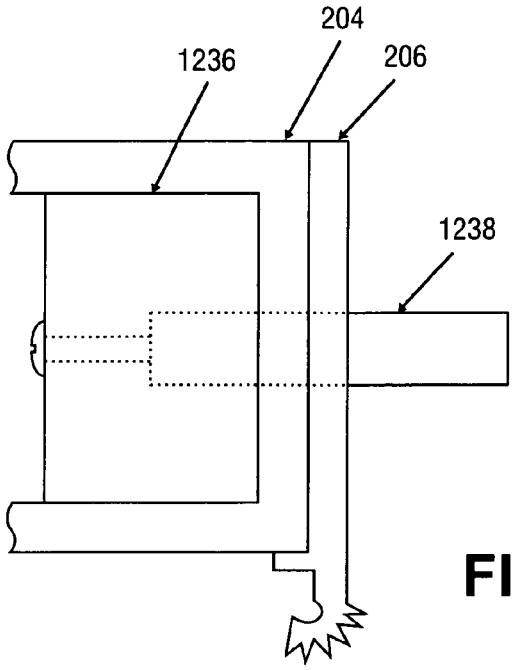
FIG. 13 illustrates a cross-sectional view of a hinge anchorage for a window system.

FIG. 12 illustrates an exploded view of the hinge 206 mechanism and glazing channel assembly. The hinge 206 is fastened by one leaf to the anchor tube 202 and by the other leaf to the frame section 824. A brace bar 1236 is attached to the inside of frame section 824 and fastened to lugs 1238 that protrude through holes in frame section 824, through both leaves of hinge 206 and into the holes of anchor tube 202 when the hinge 206 is closed. FIG. 13 illustrates a cross section of a closed hinge with lug 1238, brace bar 1236, frame 204 and hinge 206. The hinge side of the frame 204 is locked to the anchor tube 202 to enhance the inherent lateral pressure strength of the window system 200 with a set of lug pins 1238. In one embodiment, the lug pins 1238 are solid stainless steel. The lug pins 1238 aid in bearing the stress of an explosive force thereby alleviating the stress of the explosive force on the hinge 206. This improves the probability that the window system 200 will be available for emergency egress after withstanding an explosion or other force impact because less shearing stress will be applied to the hinge 206 preventing damage to the hinge 206 that would render it inoperable. The lug pins 1238 are spaced horizontally across from the lock lugs 818 to minimize warp of the frame 204 during the positive or negative phase of an explosion.

In one embodiment, the hinge 206 and lug pins 1238 are attached to a brace bar 1236. The brace bar 1236 is manufactured of a solid high strength structural aluminum alloy such as structural aluminum 6061-T6 or similar materials. The brace bar 1236 serves as a locking and pullout resistant mount. The brace bar 1236 is located within the frame 204.

In one embodiment, the glazing assembly includes tape 1240 placed in the glazing channel between the glazing 210 and the frame 204. A second layer of tape 1240 is placed in the channel between the glazing 210 and the infill bar 314. A third layer of tape 1240 is placed in the glazing channel between the infill bar 314 and the glazing stop 312. Spring pins 442 are coupled to the glazing stop 312 to secure the glazing stop 312 in the trench of the frame 204.

In one embodiment, the tape 1240 is a closed cell very high bond acrylic high density tape with Ultra Violet resistance and resistance to moisture, solvents and plasticizer migration. In one embodiment, structural liquid adhesives or similar materials having an ultimate tensile strength of 335 to 350 PSI, an ultimate elongation percentage of 300 to 525 percent, Ultra Violet resistance, movement capability in the range of ±25 to 50 percent, a tensile strength at 100 percent elongation of 90 to 175 PSI and a durometer hardness of Shore A scale 35 to 40 is used in place of or in combination with tape 1240.

Figure 14:
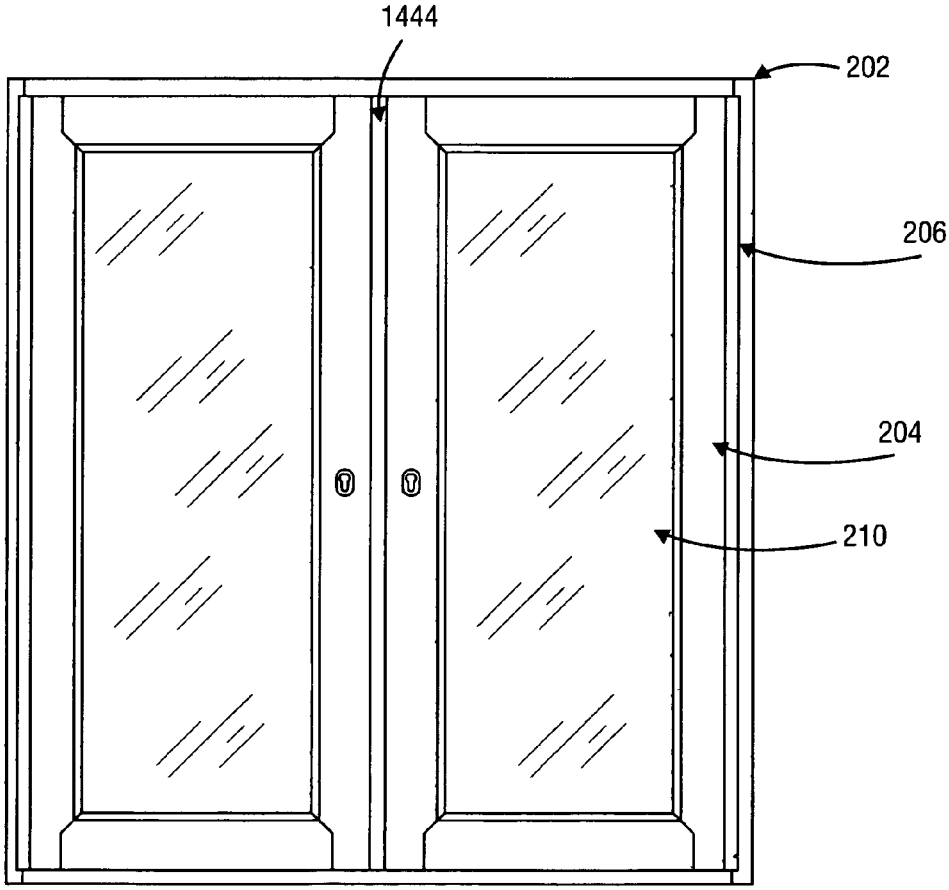
FIG. 14 illustrates a double frame window system with an astrigal.
Figure 15:
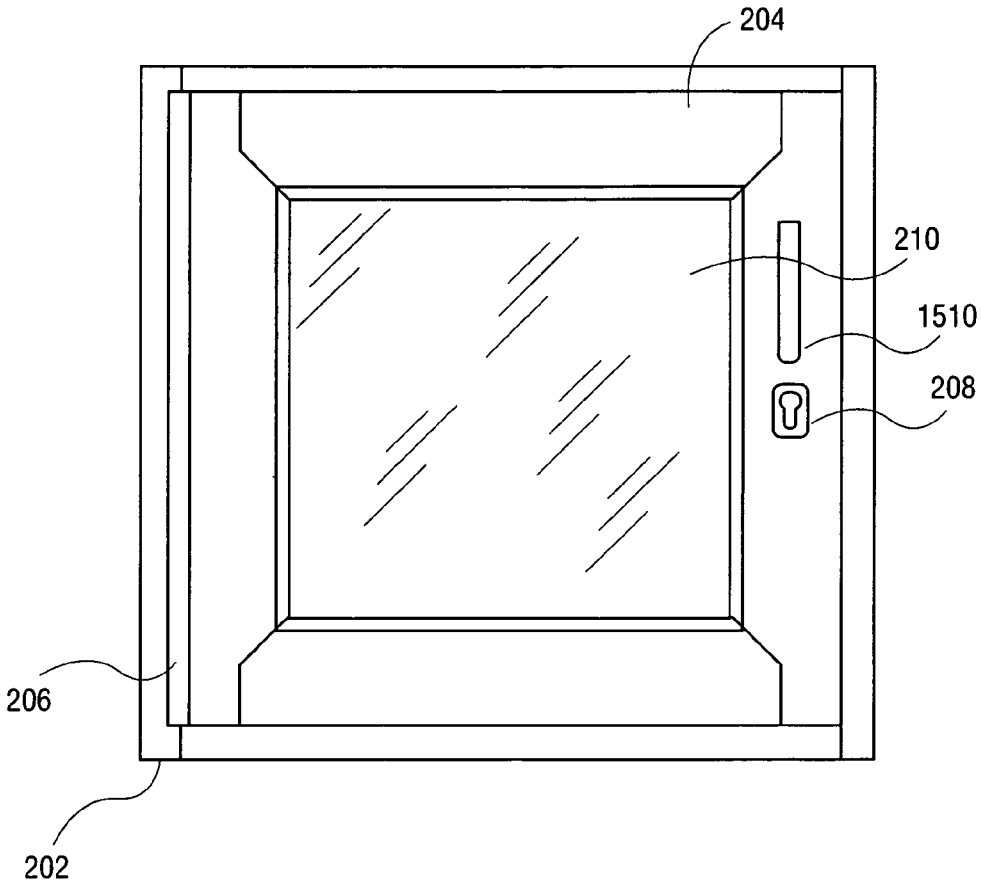
FIG. 15 illustrates a window system including a handle.

FIG. 15 illustrates one embodiment, having a handle 1510 or similar device attached to the frame 204 on the safe side to facilitate access to the window system 200. In another embodiment, the handle 1510 is coupled to the lock mechanism 208 to engage and disengage the lock lugs 818 of the locking mechanism 208. This embodiment can be used as a door or other portal. FIG. 14 illustrates an embodiment where two frames 204 are placed in a single anchor tube 202 with an astrigal 1444 between the frames 204 to engage the locking mechanism 208 of each frame 204. This embodiment, can be a double window, door or similar portal.

Figure 16:
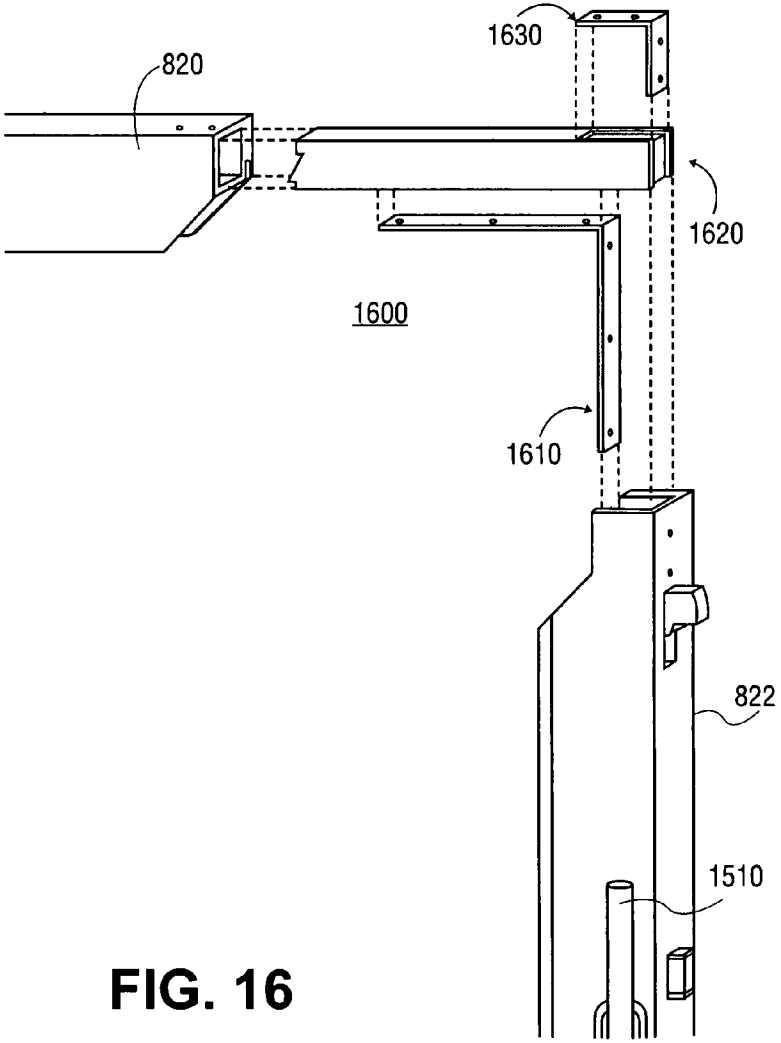
FIG. 16 illustrates an exploded view of a reinforced corner of a window.

FIG. 16 illustrates one embodiment of a corner strengthening system 1600. Frame section 820 is secured to frame section 822 or 824 by inner reinforcement bar 1610, outer reinforcement bar 1630 and infill bar 1620. In one embodiment, inner reinforcement bar 1610 is a 3/16-inch thick steel alloy that is 12 to 24 inches in length from its central bend to each of its outer ends. A set of screws or similar fasteners are used to fasten inner reinforcement bar 1610 to infill bar 1620 and the inner wall of frame sections 820, 822 and 824. Infill bar 1620 and the inner wall of frame sections 820, 822 and 824 are tapped to provide threaded holes to receive screws in order to secure the inner reinforcement bar 1610 to the infill bar 1620 and frame sections 820, 822 and 824. Outer reinforcement bar 1630 is a 3/16-inch thick steel alloy that is 6 to 12 inches in length from its center bend to each of its outer ends.

A set of screws or similar fasteners fasten outer reinforcement bar 1630 to infill bar 1620 and the outer wall of frame sections 820, 822 and 824. Infill bar 1620 and the outer wall of frame sections 820, 822 and 824 are tapped to provide threaded holes to receive screws in order to secure the inner reinforcement bar 1610 to the infill bar 1620 and frame sections 820, 822 and 824. In one embodiment, the dimensions of infill bar 1620 are ¾ inch by 1.83 inches plus the length of the upper frame 820 and connecting space. Infill bar 1620 runs the length of each section 820 and is connected to frame sections 822 and 824 at each end by reinforcement bars 1610 and 1630. Infill bar 1620 is composed of a structural aluminum (6061-T5). The reinforcement mechanism 1600 allows the window system 200 to withstand torsional forces at the corners. The corner strengthening system 1600 allows the window system to remain functional after surviving a blast at 4 PSI or less. This allows a user to egress from a building through the window system 200 after a 4 PSI or less blast. Window system 200 with corner strengthening system 1600 provides GSA level 2 protection.

Figure 17:
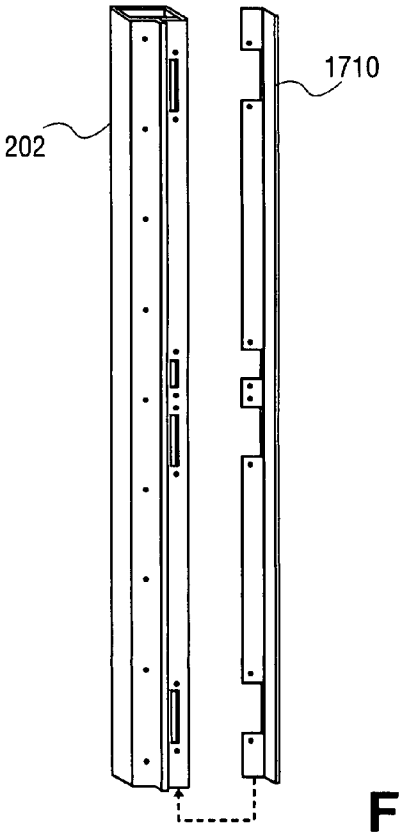
FIG. 17 illustrates an exploded view of a reinforced anchor tube.

FIG. 17 illustrates one embodiment of the anchor tube 202 that includes a strike reinforcement bar 1710. The strike reinforcement bar 1710 is an angled steel reinforcement bar that runs the length of the anchor tube 202 with a thickness that ranges from ⅛ inch to 3/16 inch. A ⅛ inch angled steel reinforcement bar is used for embodiments that are designed to withstand forces up to 15 PSI. A 3/16 inch angled steel reinforcement bar is used for embodiments that are designed to withstand forces greater than 15 PSI. The strike reinforcement bar 1710 is notched across one surface to accommodate the openings in the anchor tube 202 for receiving lugs 818 of the multipoint locking mechanism 208 from the frame section 822. The strike reinforcement bar 1710 is sleeved into the strike side of the anchor tube 202 and attached using screws or similar attaching devices. In one embodiment, strike reinforcement bar 1710 and anchor tube 202 are tapped to provide threaded holes to receive screws and secure the strike reinforcement bar 1710 to the anchor tube 202. The strike reinforcement bar 1710 improves the resilience of the anchor tube under blast pressure and the torsional forces caused by the blast. In one embodiment, a strike reinforcement bar 1710 without notches is used in frame sections that do not receive the multipoint locking system lugs 818.

Figure 18:
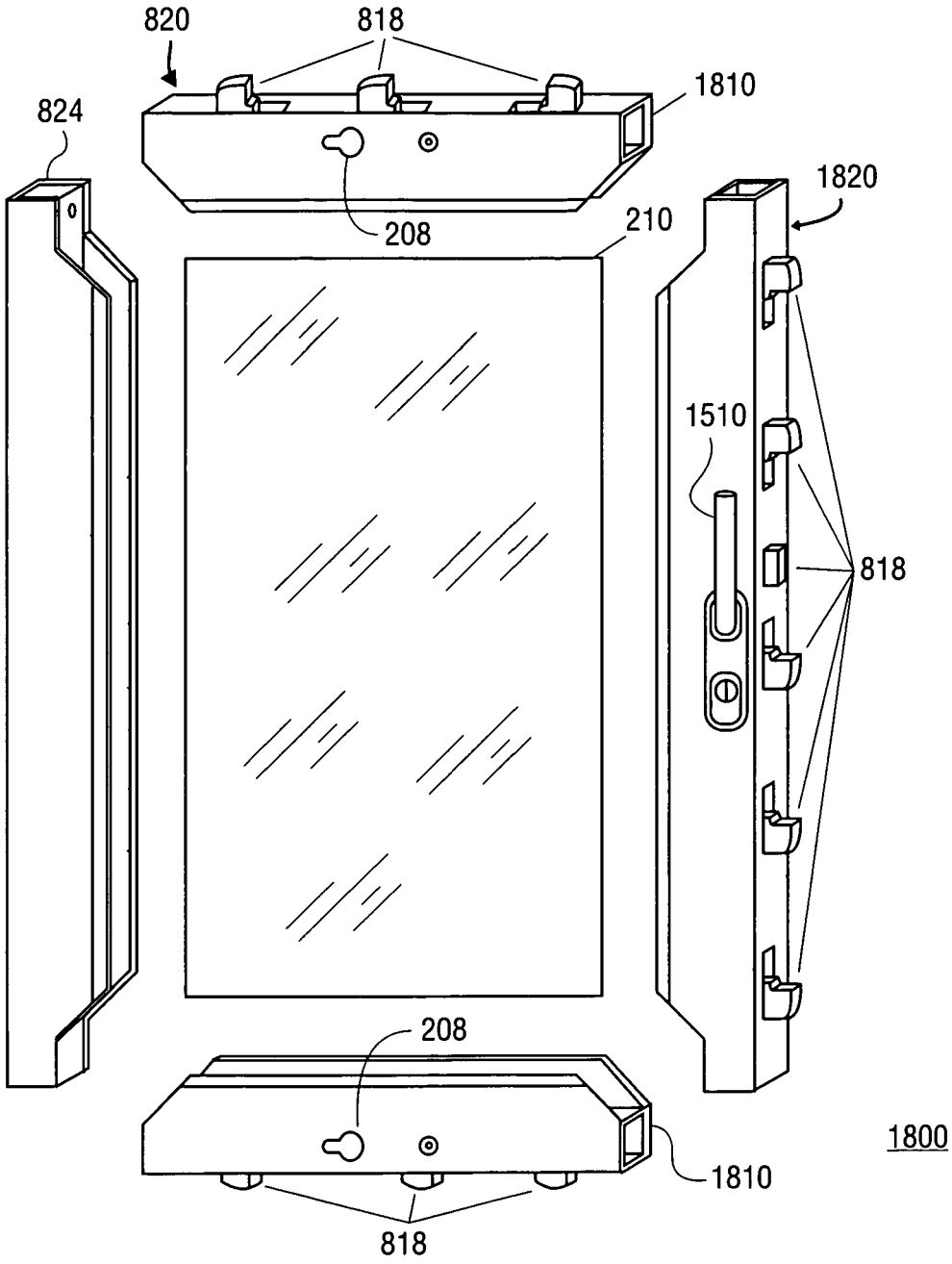
FIG. 18 illustrates an exploded view of a window system with top and bottom locks.

FIG. 18 illustrates a high-pressure window system 1800. This window system 1800 is similar to window system 200, but includes additional structures to allow the window system 1800 to withstand pressures greater than 4 PSI. In one embodiment, the high-pressure window system includes a glazing 210, hinge-side frame section 824, handle-side frame section 1820, handle 1510, multipoint locking mechanisms 208 and upper and lower frame sections 1810. The multipoint locking mechanism 208 in frame section 1820 includes at least five lugs 818 as part of the engagement mechanism of frame section 1820. Frame sections 1810, also include separate multipoint locking mechanisms 208 in each section. These sections include at least three lugs 818 as a part of the locking mechanism 208 associated with each section 1810. The number of lugs 818 in frame sections 1810 is proportional to the length of sections 1810. The additional lugs 818 in frame sections 1820 and 1810 improve the window system's 1800 resilience to blast pressure, allowing the window system 1800 to withstand pressures greater than 4 PSI and remain functional so that a user can egress through the window after the window system 1800 withstands a blast. In one embodiment, window system 1800 can withstand at least a 20 PSI blast while providing level 2 GSA protection.

Figure 19:
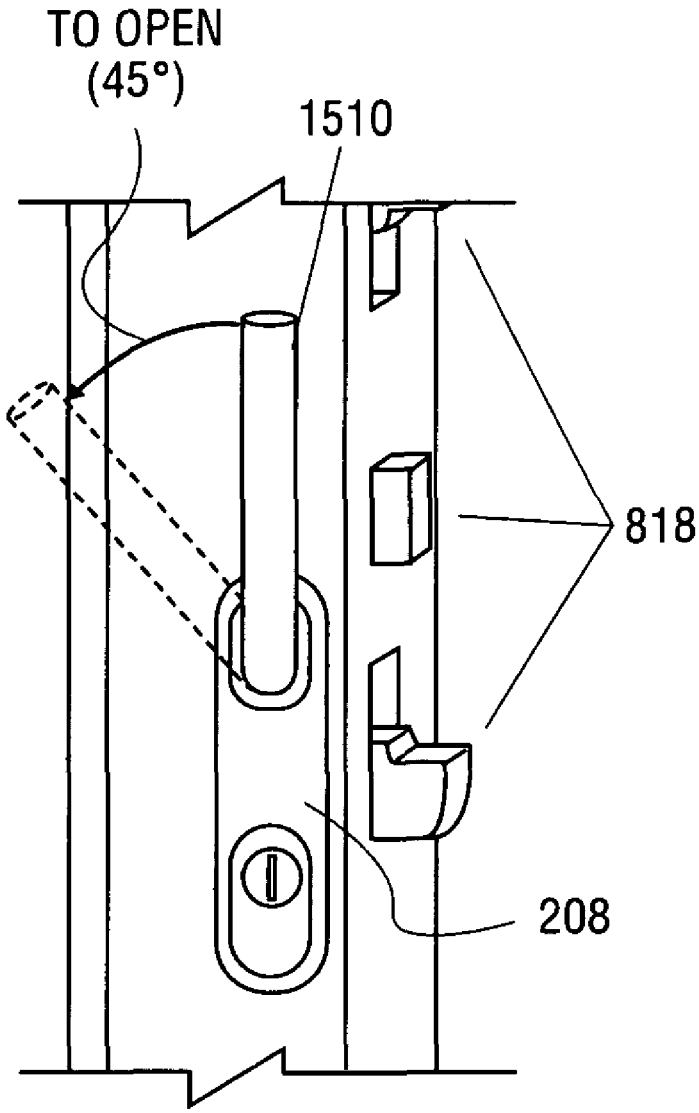
FIG. 19 illustrates a handle mechanism of a window system.

FIG. 19 illustrates handle mechanism 1510. In one embodiment, handle 1510 is attached to lugs 818 in frame section 822 or 1820 through the multipoint locking mechanism 208 and is used to provide leverage to a user for disengaging the lugs 818 through the locking mechanism 208. In one embodiment, the handle must be turned 45 degrees in order to disengage the lugs 818 from the anchor tube 202. This minimizes the likelihood of an unintentional opening of the window system 200. To disengage lugs 818 the lock mechanism 208 must be in an unlocked state and the handle 1510 turned 45 degrees. Separate locking mechanisms 208 are used for each frame section 1810 and frame section 1820. This allows the window system 1800 to remain functional after withstanding a blast, which has a high torsional force component, because separate locking mechanisms are in each frame section 1810 and 1820. These torsional forces cause a high degree of stress at the corners of the window system 1800. In contrast, the torsional forces at the corners during a blast would damage any central locking system that controlled locking lugs in adjacent frame sections via the corners of a window system. A window system having a central locking system would be inoperable after withstanding a blast thereby blocking egress from the building.

Figure 20:
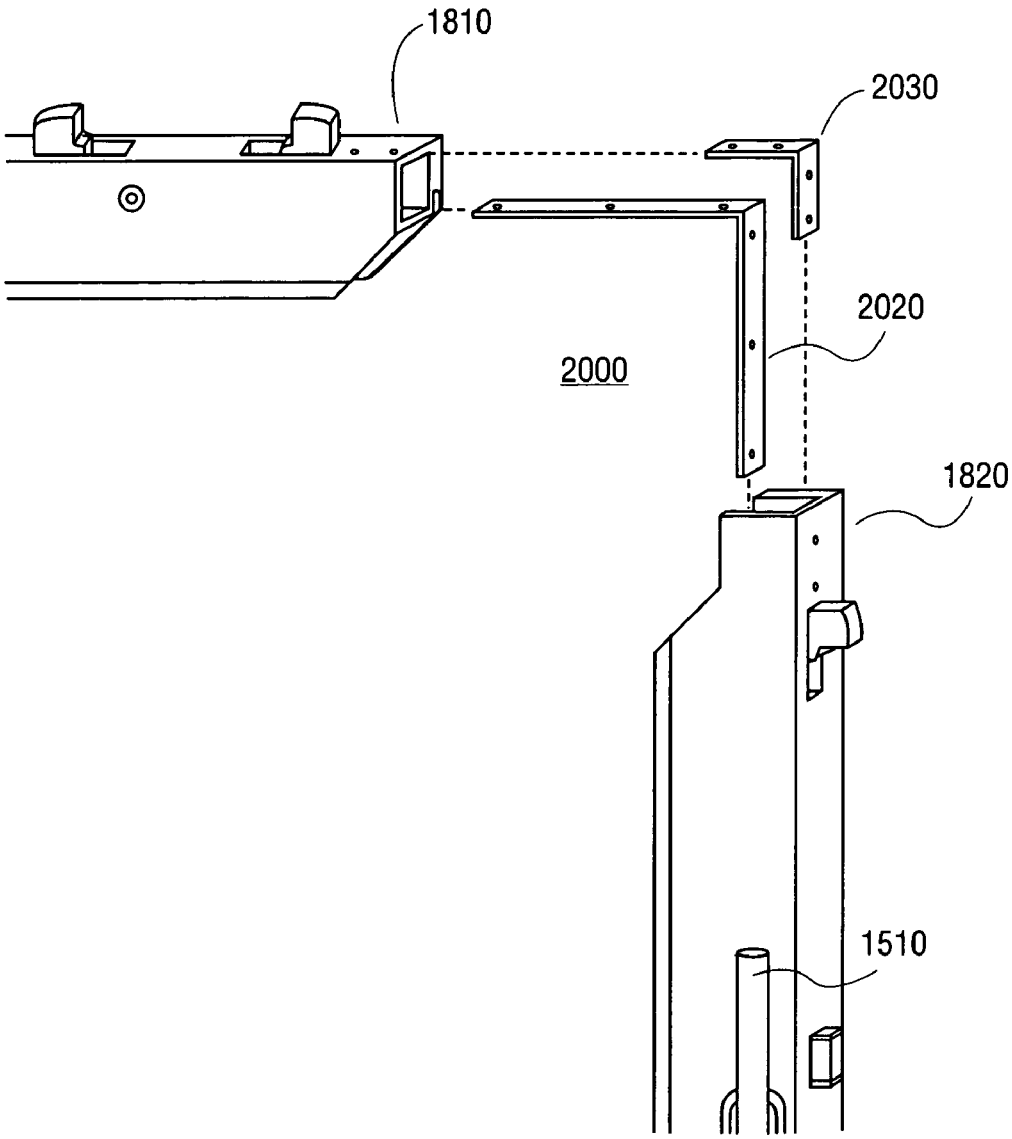
FIG. 20 illustrates an exploded view of a reinforced corner of a window system.

FIG. 20 illustrates an exploded view of a corner reinforcement system 2000. In one embodiment, this corner reinforcement system 2000 is used with high-pressure window system 1800. Reinforcement system 2000 includes inner reinforcement bar 2020 and outer reinforcement bar 2030. In one embodiment, an inner reinforcement bar 2020 and outer reinforcement bar 2030 are used in each corner of window system 1800. The inner reinforcement bar 2020 is close to the glazing side and the outer reinforcement bar 2030 is close to the jamb side. In one embodiment, inner reinforcement bar 2020 is a 3/16-inch thick steel alloy that is 12 to 24 inches in length from its central bend to each of its ends. Screws or similar fasteners are used to fasten inner reinforcement bar 2020 to the inner wall of frame sections 1810, 1820 and 824. Outer reinforcement bar 2030 is a 3/16-inch thick steel alloy that is 6 to 12 inches in length from its center bend to each of its end. Screws or similar fasteners fasten outer reinforcement bar 2030 to the inner wall of frame sections 1810, 1820 and 824. In one embodiment, the inner wall of frame sections 1810, 1820 and 824 and the reinforcement bars 2020 and 2030 are tapped to provide threaded holes for receiving screws to securely attach the reinforcement bars 2020 and 2030 to frame sections 1810, 1820 and 824. The reinforcement mechanism 2000 allows the window system 1800 to withstand torsional forces at the corners. The corner strengthening system 2000 allows the window system to remain functional after surviving a blast greater than 4 PSI. This allows a user to egress from a building through the window system 1800 after a 4 PSI or greater blast. The corner strengthening system 2000 can withstand at least a 20 PSI blast while providing level 2 GSA protection.

In another embodiment, the window system 1800 may be modified to withstand blast pressures of up to 40 PSI or greater. Thicker glazings are used that are up to approximately 2.75 inches in thickness. The dimensions of frame 204 and anchor tubing 202 are modified proportionately. The overall depth of the window system 1800 increases to up to 3.25 inches. The depth of the channels in which the glazing 210 rests also increases in height. Locking pins 1238 which are ⅜ inch in diameter for embodiments designed to withstand blasts of 15 PSI or less are increased to ½ inch in diameter to withstand blast pressures greater than 15 PSI.

Method of Installing the Present Invention to Existing Building Materials

Attach the anchor tube 202 to the sill 18, trimmer studs 23, king studs 22 and 26, and header 30 every second predetermined distance. In the one embodiment, anchors are provided every twelve (12) inches, or a minimum of three (3) anchors per lineal length are provided (if the length of lineal length is too short to permit twelve inch spacing). Lineal length used herein refers to one of the four sides of the improved window system 200 or 1800. Should one side be less than twelve (12) inches in length, a minimum of three anchors are still provided for that lineal length.

Place the glazing 210 into the frame 204.

Insert the infill bars 314 into the glazing channels.

Place glazing stops 312 into frame 204.

Insert spring pins 442 into glazing stops 312.

Couple the frame 204 to the anchor tube 202 via hinge 206 and lock points.

Optionally, couple steel reinforcement bar 1710 to anchor tube, couple frame 204 together at corners with steel reinforcement bars 2020 and 2030 or 1610, 1630 and infill bar 1620.

Fastening means or anchoring means used herein can include, but are not limited to, threaded fasteners such as nuts and bolts, screws, adhesives and epoxies, hooks, rivets, welding, surface tension, steel shaft rivets, wedge or sleeve expansion anchors, coil-loop or epoxy anchors, etc.

In the one embodiment, the anchor tube 202 frame 204, infill bar 314, brace channel 926, glazing stop 312 and brace bar 1236 are manufactured by an extrusion process and are manufactured from aluminum. For straight portions, to be used in rectangular or square windows, aluminum 6063-T5 is used. For windows having non-straight portions (e.g., circular windows or arched windows), the aluminum 6063-T1 may be used. The aluminum 6063-T1 provides additional malleability so that the material can be formed into curved portions. This forming adds to the material strength using the work hardening process incurred through the bending and shaping of the lowered temperature aluminum (6063-T1) resulting in strengths equivalent to aluminum 6063-T5.

In the foregoing specification, the invention has been described with reference to specific exemplary embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. An apparatus comprising:

a glazing;

at least one first support structure having a first surface to engage a building material and a second surface, wherein a wall forming the second surface is thicker than a wall forming the first surface;

at least one second support structure having a first portion that defines at least a portion of a channel to support the glazing; and at least one third support structure that defines at least a portion of the channel to support the glazing which is removeably coupled to the at least one second support structure to allow removal of the glazing, wherein the glazing in the channel between the second and third support structures can withstand at least 4 pounds per square inch applied positive phase explosive blast force.

2. An apparatus comprising:

at least one first support structure having a first surface to engage a building material and a second surface;

at least one second support structure having a first portion that defines at least a portion of a channel to support a glazing;

at least one third support structure that defines at least a portion of the channel to support the glazing which is removeably coupled to the at least one second support structure to allow removal of the glazing; and a fourth support structure having a first surface to engage the second surface of the at least one first support structure, the fourth support structure to restrict the lateral movement of the second support structure, wherein the glazing in the channel between the second and third support structures can withstand at least 4 pounds per square inch applied positive phase explosive blast force.

3. The apparatus of claim 1 further comprising:

a multiple point lock mechanism within the at least one second support structure.

4. The apparatus of claim 3 further comprising:

a handle coupled to the at least one second support structure to move the at least one second support structure in relation to the at least one first support structure.

5. The apparatus of claim 1 further comprising:

a reinforcing structure inserted in the at least one first support structure.

6. The apparatus of claim 1 wherein the at least one second support structure is coupled to the at least one first support structure with a hinge.

7. The apparatus of claim 6 wherein the hinge includes at least one locking pin to bear the stress of an external pressure on the hinge.

8. An apparatus comprising:

at least one first support structure having a first surface to engage a building material and a second surface;

at least one second support structure having a first portion that defines at least a portion of a channel to support a glazing;

at least one third support structure that defines at least a portion of the channel to support the glazing which is removeably coupled to the at least one second support structure to allow removal of the glazing; and at least one spring pin to secure the at least one third support structure to the at least one second support structure, wherein the glazing in the channel between the second and third support structures can withstand at least 4 pounds per square inch applied positive phase explosive blast force.

9. An apparatus further comprising:

at least one first support structure having a first surface to engage a building material and a second surface;

at least one second support structure having a first portion that defines at least a portion of the channel to support a glazing;

at least one third support structure that defines at least a portion of the channel to support the glazing which is removeably coupled to the at least one second support structure to allow removal of the glazing; and a fourth structure that is coupled to a first at least one second support structure and a second at least one second support structure to resist an external force that may separate or contort the first at least one second support structure and the second at least one second support structure, wherein the glazing in the channel between the second and third support structures can withstand at least 4 pounds per square inch applied positive phase explosive blast force.

10. The apparatus of claim 1 wherein one of the at least one first structure and the at least one second structure are made from one of an aluminum 6063-T5 material and an aluminum 6063-T1 material.

11. An apparatus comprising:

means for anchoring a frame to a building; and means for holding a glazing in a frame, wherein the apparatus can withstand at least a 4 pounds per square inch applied positive phase explosive blast force.

12. The apparatus of claim 11 further comprising:

means for restricting the lateral movement of the frame.

13. The apparatus of claim 11 further comprising:

means for securing the glazing in a frame which is removeable to allow removal of the glazing from the frame.

14. The apparatus of claim 11 further comprising:

means for moving the frame in relation to the anchoring.

15. The apparatus of claim 11 further comprising:

means for locking the frame to the anchoring.

16. The apparatus of claim 11 further comprising:

means for reinforcing the corners of the frame.

17. The apparatus of claim 11 further comprising:

means for reinforcing the means for anchoring the frame.

18. A method comprising:

attaching at least one first structure to a building material with a set of anchors spaced apart based on a desired protection level;

attaching at least one second structure that is configured to hold a glazing to the at least one first structure; and inserting a glazing into the at least one second structure, wherein the glazing can withstand at least a four pounds per square inch applied positive phase explosive blast force, and wherein the second structure includes a multi-point locking mechanism.

19. The method of claim 18 further comprising:

inserting a reinforcement structure into the at least one first structure with a strength determined by the desired protection level.

20. The method of claim 18 further comprising:

coupling a first portion of the at least one second structure to a second portion of the at least one structure with at least one angled reinforcement bar.

21. An apparatus comprising:

a first structure to engage a building material;

a second structure coupled to the first structure to hold a glazing; and a hinge couple to the first structure and second structure, wherein the apparatus can withstand at least a four pounds per square inch applied positive phase explosive blast force, and wherein the hinge functions to allow egress after withstanding the at least four pounds per square inch applied positive phase explosive blast force.

22. A frame comprising:

an anchor structure to engage a building material;

a frame coupled to the anchor structure to hold a glazing, the frame configured to hold glazings of a width in the range of $5/16$ of an inch to $15/16$ of an inch, wherein the frame can withstand at least a four pounds per square inch applied positive phase explosive blast force.

23. A frame comprising:

a first structure to engage a building material;

a second structure to hold a glazing; and a lock mechanism coupled to the second structure including a plurality of bolts to engage a first side of the first structure;

a set of lugs to engage a second side of the first structure with the second structure, wherein the glazing can withstand at least a four pounds per square inch applied positive phase explosive blast force.

24. The apparatus of claim 1 wherein the glazing is a laminated glass composite.

25. The apparatus of claim 24 wherein the laminated glass composite includes polyvinylbutyral, polyethylene terephthalate, or mixtures thereof.

26. The apparatus of claim 1 wherein the second surface is parallel to the first surface.

* * * * *